United States Patent [19]

Henshaw

[11] 4,213,742

[45] Jul. 22, 1980

[54] MODIFIED VOLUTE PUMP CASING

[75] Inventor: Terry L. Henshaw, Battle Creek, Mich.

[73] Assignee: Union Pump Company, Battle Creek, Mich.

[21] Appl. No.: 842,725

[22] Filed: Oct. 17, 1977

[51] Int. Cl.[2] ..... F03B 3/00

[52] U.S. Cl. ..... 417/206; 417/219

[58] Field of Search ..... 415/206, 207, 219 A, 415/219 C

[56] References Cited

U.S. PATENT DOCUMENTS

| | | | |
|---|---|---|---|
| 839,273 | 12/1906 | Davidson | 417/204 |
| 1,215,881 | 2/1917 | Siemen | 417/68 |
| 2,291,138 | 7/1942 | Blom | 415/206 |
| 3,289,598 | 12/1966 | Buse et al. | 415/205 |
| 3,759,628 | 9/1973 | Kempf | 415/213 A |
| 3,846,040 | 11/1974 | Dennis | 415/219 C |
| 3,950,112 | 4/1976 | Crump | 415/219 C |

*Primary Examiner*—William L. Freeh

*Attorney, Agent, or Firm*—Price, Heneveld, Huizenga & Cooper

[57] ABSTRACT

The specification discloses a centrifugal pump in which radial thrust on the impeller shaft is reduced by employing a modified volute casing in which the casing flow area downstream from the cutwater to a point generally opposite the cutwater is significantly greater than would be the flow area of a true volute casing, the area at a point generally opposite the cutwater being significantly less than the flow area of a true volute casing and the area just upstream of the throat back towards the point opposite the cutwater being significantly greater than would be the flow area of a true volute casing.

19 Claims, 8 Drawing Figures

MODIFIED VOLUTE PUMP CASING

BACKGROUND OF THE INVENTION

The present invention relates to centrifugal pumps and more particularly to the volute casing for such a pump. In a volute casing, flow area increases as one proceeds from the cutwater of the pump to the exit throat. The volute configuration causes the pump to be more efficient since it keeps the stream flow constant. If a volute configuration were not employed, one would have turbulence.

A significant problem encountered with such pumps is that a radial load is imposed on the impeller shaft, particularly when the pump is operating either below or above its best-efficiency-point capacity. Such radial loading creates problems of wear, leakage at the seal(s), the need for larger bearings and stiffer impeller shafts.

One way in which radial thrust can be reduced, at least to some extent, is through the use of a dual volute or double volute casing in which an internal wall known as a splitter extends around the impeller for 180°, dividing the annular chamber surrounding the impeller into two volute chambers. Such a splitter generally starts at a point approximately 180° opposite the cutwater. I have also heretofore suggested the production of volute casings employing a fake tongue or splitter located generally opposite the cutwater and extending for only a short distance, rather than the full 180° of a normal splitter.

However, such casings are more expensive to cast particularly where the splitter is a full 180° partition. Also, casings are heavier and more difficult to clean. Consequently, this construction is usually provided only in larger size pumps.

As a result, there has long been a need for alternative means for reducing the radial load or thrust on an impeller shaft so as to minimize wear, leakage, the need for larger bearings and stiffer shafts.

SUMMARY OF THE INVENTION

The present invention reduces radial load by approximately 45% without significantly affecting capacity, head pressure or efficiency. In one aspect of my invention, I have discovered that I can decrease the loads imposed on the impeller shaft when the centrifugal pump is operating below its best-efficiency-point capacity by increasing the casing flow area above that of a true volute casing in the area from just downstream of the cutwater towards a point generally opposite the cutwater. In a second aspect of the invention, I have discovered that by increasing the flow area above the flow area of a true volute casing on the opposite side of the casing, i.e. from a point just upstream of the throat rearwardly towards the point generally opposite the cutwater, I can decrease the radial loads imposed on the impeller shaft when the centrifugal pump is operating at capacities above the best efficiency point. Finally, I have discovered that by decreasing the flow area below the flow area of a true volute casing in the area generally opposite the cutwater, I can decrease radial loading caused by the so-called "cutwater effect" which is a factor in generally all pump operating capacities.

These and other aspects, objects and advantages of my invention will be more fully understood and appreciated by reference to the description of the preferred embodiment and the appended drawings.

DESCRIPTION OF THE PREFERRED EMBODIMENT

Figure 1:
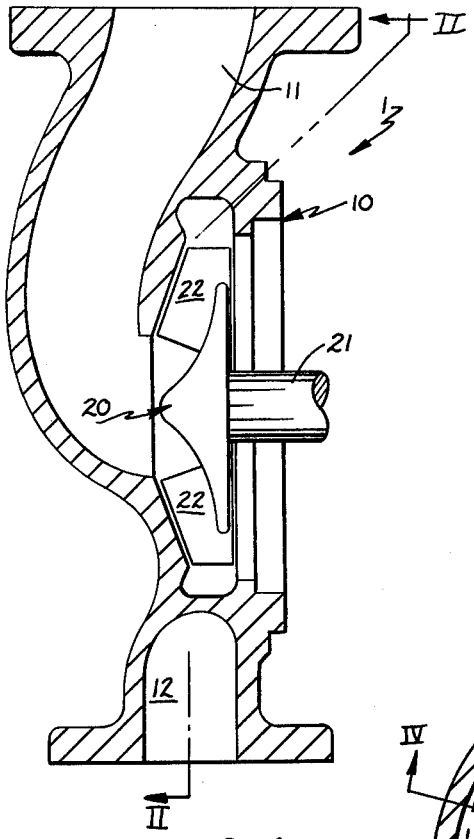
FIG. 1 is a vertical, lateral cross section taken through the centrifugal pump of my invention (with the motor, coupling, cover, and seal deleted)

In the preferred embodiment, the casing 10 of the centrifugal pump 1 made in accordance with the present invention has an inner wall 14 which deviates from the configuration of a true volute, the true volute being indicated by dashed lines 30 in FIGS. 2–6. These variations in casing flow area are illustrated graphically in FIG. 7 which charts casing flow area as a percent of throat area against the number of degrees from cutwater 13. Casing flow area refers to the area of the space between the interior wall 14 of casing 10 and the periphery of impeller 20.

Figure 2:
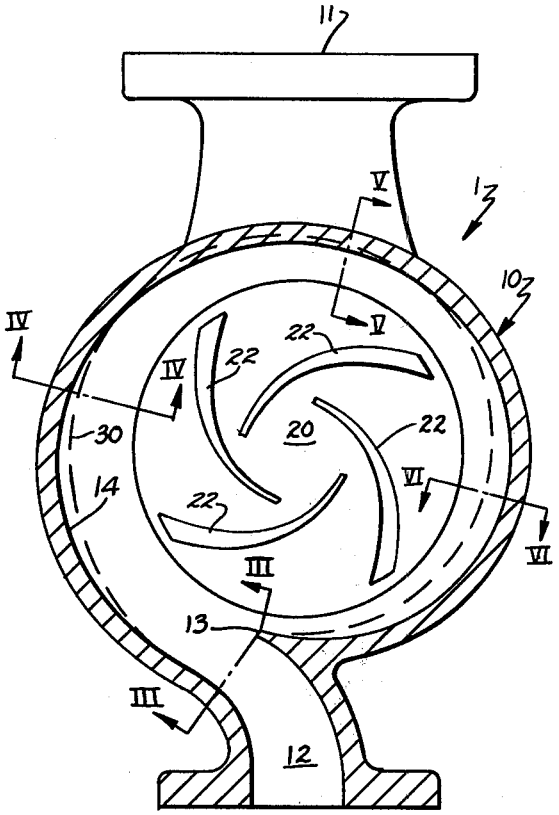
FIG. 2 is a cross-sectional view taken along plane II—II of FIG. 1, with the dashed line showing the outline of the internal wall of a true volute casing.
Figure 3:
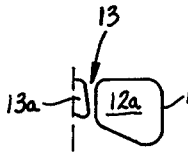
FIG. 3 is a cross-sectional view taken along plane III—III of FIG. 2 at the cutwater and throat.
Figure 4:
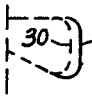
FIG. 4 is a cross-sectional view taken along plane IV—IV of FIG. 2 270° downstream from the cutwater, the dashed line representing a true volute casing wall.
Figure 5:
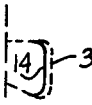
FIG. 5 is a cross-sectional view taken along plane V—V of FIG. 2 180° downstream from the cutwater, the dashed line representing a true volute casing wall.
Figure 6:
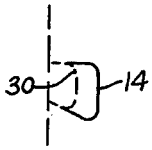
FIG. 6 is a cross-sectional view taken along plane VI—VI of FIG. 2 90° downstream from the cutwater, the dashed line representing a true volute casing wall.

In other respects, centrifugal pump 1 is conventional, having an inlet 11, an outlet 12, a cutwater 13 and an impeller 20 having an impeller shaft 21 and impeller blades 22 (FIGS. 1 and 2). The throat area as that term is used herein refers to the area of the throat adjacent the cutwater 13 and perpendicular to the direction of flow of fluid as it leaves centrifugal pump 1, said throat area being labeled **12*a* in FIG. 3. The flow area of the casing at the cutwater is illustrated as 13*a* in FIG. 3**. The selection of a particular throat area and a particular cutwater flow area may be subject to various design considerations which do not form a part of the present invention. Typically, the cutwater flow area will be anywhere from 5% to 15% of the throat area and in the preferred embodiment herein is about 8% of the throat area.

For purposes of discussion, it is best to divide the casing 10 into an upstream portion, a downstream portion and a juncture portion between the two. The upstream portion extends from the cutwater around towards a point 180° from or generally opposite the cutwater. The downstream portion extends from the throat **12*a*** back towards the point opposite the cutwater. The juncture between the upstream and downstream portions is located generally at the point 180° from the cutwater and extending for some distance to either side thereof.

Figure 7:
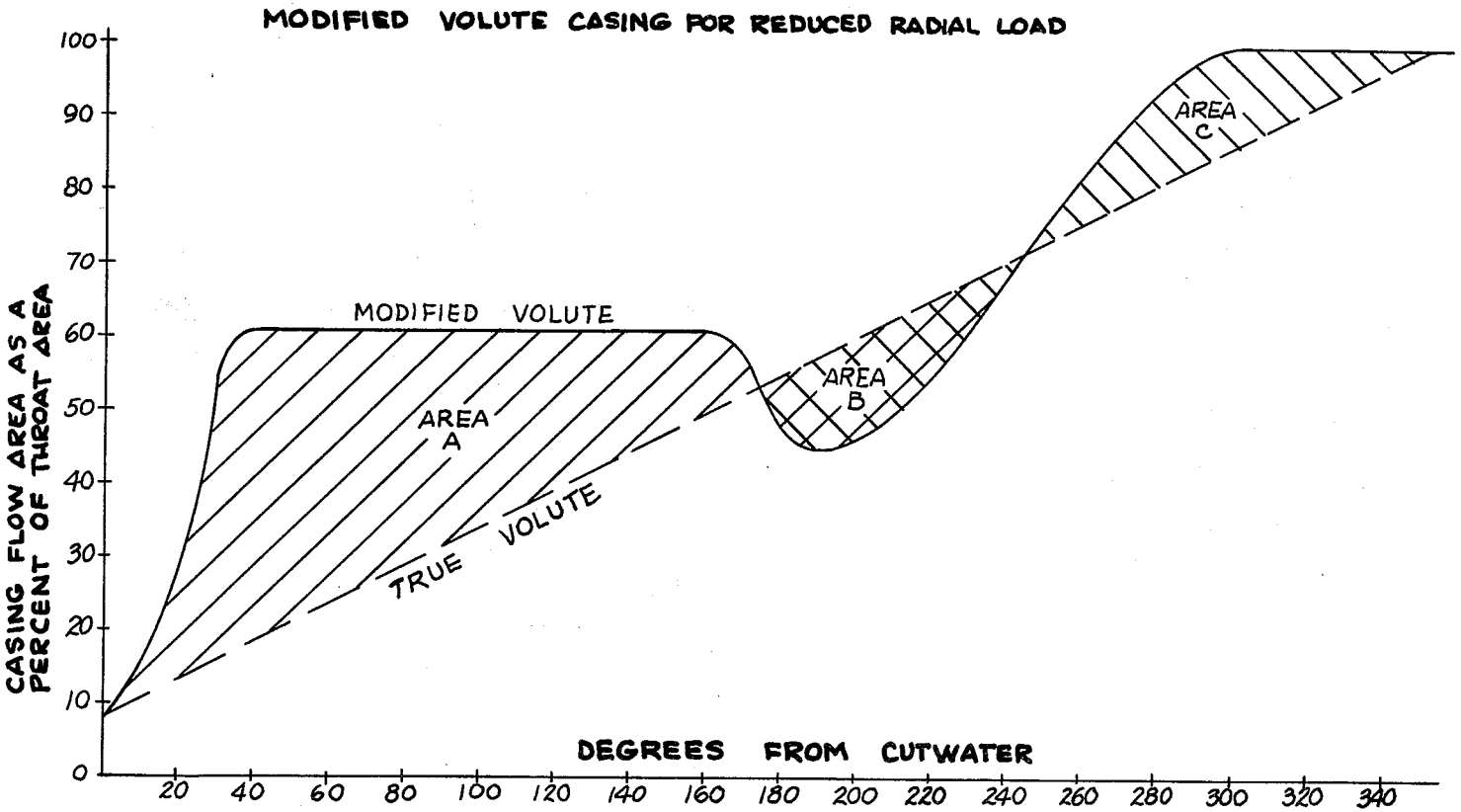
FIG. 7 is a chart comparing the modified volute flow area with a true volute flow area in which the ordinate is the casing flow area as a percent of the throat area while the abscissa represents degrees from the cutwater.

I have found that radial thrust occurring when the pump 1 is operating below its best-efficiency-point capacity can be significantly reduced by increasing the casing flow area in the upstream portion of pump 1. Referring to FIG. 7, it will be seen that from the cutwater to approximately 40° downstream thereof, I rapidly increase the flow area of the casing to about 60% of the throat area. In contrast, the flow area of the casing of a true volute would have increased to only about 20% of the throat area at a point 40° from the cutwater. Then, I maintain a flow area of approximately 60% of throat area from about 40° to about 160° downstream from cutwater 13.

At that point, the casing flow area actually begins to decrease and at about 170° downstream of the cutwater, at the beginning of the juncture area of the pump, the casing flow area actually becomes less than would be the flow area of a true volute casing. This condition continues through the juncture zone to a point about 245° downstream from cutwater 13. At about 190°, the casing flow area is only about 45% of the throat area whereas for a true volute, the casing flow area would be about 55% of the throat area at the same point.

This decrease in casing flow area at a point generally opposite cutwater 13 significantly reduces radial thrust which is caused by the so-called "cutwater effect". The radial thrust resulting from the cutwater effect is generally observed under all operating conditions of a centrifugal volute casing pump.

In the downstream portion of the casing, specifically from about 240° downstream from cutwater 13 around to the beginning of throat 12*a* (section III—III of FIG. 2), the flow area of the casing is actually greater than would be the flow area of a true volute casing. As can be seen by reference to FIG. 7, the flow area of my modified volute casing gradually exceeds the true volute flow area beginning at about 240° and continues its relative increase until at about 300° downstream from cutwater 13, where the flow area of my modified volute casing is actually 100% of throat area. The casing flow area then continues (from 300° to 360°) to be equal to throat area 12*a*. This increase in casing flow area in the downstream portion of centrifugal pump 1 significantly reduces radial thrust on impellor shaft 21 when centrifugal pump 1 is operating at a capacity above its best-efficiency-point.

Figure 8:
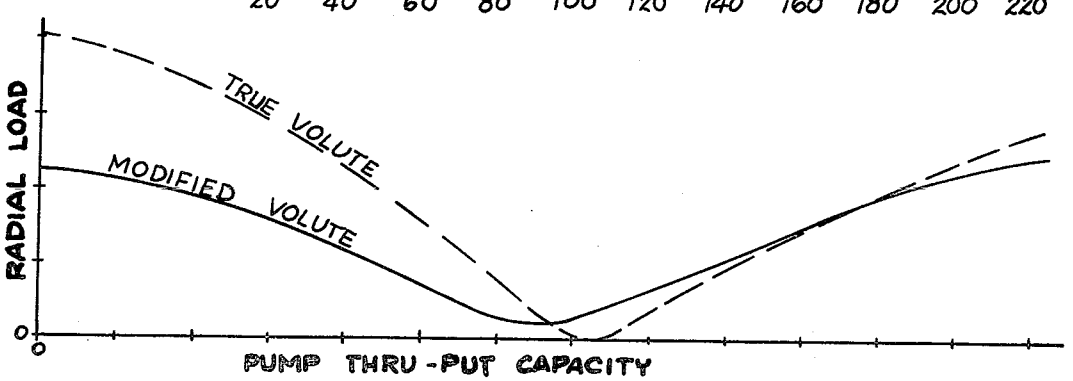
FIG. 8 is a chart comparing radial load in a true volute casing pump verses radial load in my modified volute pump in which radial load is charted on the ordinate and pump through-put capacity is charted on the abscissa.

FIG. 8 graphs the improved results in radial thrust against pump through-put capacity. The radial load in a true volute casing is indicated by the dashed line while the radial load on my modified volute casing is indicated by the solid line. As can be seen, radial load is significantly decreased by my invention in the operating range below the best-efficiency-point of the pump. Similarly, there are important decreases in radial load at points above the best efficiency point of the pump. There is only a short range in capacity output where a true volute casing exhibits somewhat better radial loading characteristics than does my modified volute casing. Even in this short range, however, the true volute casing is only slightly better in terms of radial load whereas in all other operating areas, my modified volute casing illustrates dramatically reduced radial loading characteristics.

Thus, below and above the best-efficiency-point of the pump, my invention results in as much as a 45% decrease in radial loading while pump capacity, efficiency and pressure are reduced by less than 2%.

Of course, it will be appreciated by those skilled in the art that within the parameters set forth in the preferred embodiment, various deviations and modifications can be made to suit centrifugal pumps of differing capacity, pressure or efficiency designs. Yet, the general parameters set forth hereinabove for the design of a modified volute casing will yield centrifugal pumps having more desirable radial loading characteristics without significantly adversely affecting pump pressure, capacity, or efficiency.

Accordingly, it will be understood and appreciated that various changes and alterations can be made in the preferred embodiment without departing from the spirit and broader aspects of the invention as set forth in the appended claims.

The embodiments of the invention in which an exclusive property or privilege is claimed are defined as follows.

1. A centrifugal pump having a casing, inlet, impeller, throat and cutwater, the improvement comprising: said casing being of a modified volute configuration having in the upstream portion thereof, from the cutwater towards a point generally 180° from the cutwater, a flow area which is greater than would be the flow area of a true volute casing in the same upstream casing portion; the flow area of said casing in the downstream portion thereof, from the throat back upstream towards a point generally 180° from the cutwater, also being greater than would be the flow area of a true volute casing in the same downstream casing portion; and the flow area of the casing in the juncture portion of the pump extending from the upstream portion through a point 180° from the cutwater and to the downstream portion being significantly less than would be the flow area of a true volute casing at said juncture portion.

2. The centrifugal pump of claim 1 in which the casing flow area increases relatively rapidly in the upstream portion of the casing as one proceeds from the cutwater until said flow area is approximately 60% of the throat area.

3. The centrifugal pump of claim 2 in which said casing flow area increases from the cutwater and reaches 60% of the throat area at a point approximately 40° downstream from the cutwater, then continues at about 60% of the throat area until approximately 160° downstream from the cutwater at which point it begins to decrease.

4. The centrifugal pump of claim 3 in which said casing flow area decreases as one proceeds from the upstream portion of the casing to the juncture portion of the casing until it reaches approximately 45% of the throat area in said juncture portion.

5. The centrifugal pump of claim 4 in which said casing flow area reaches 45% of the throat area at a point approximately 190° downstream from said cutwater and begins to gradually increase from a point approximately 190° downstream from said cutwater until it equals the flow area of a true volute casing at a point approximately 240° downstream from said cutwater.

6. The centrifugal pump of claim 5 in which said casing flow area increases in said downstream portion of said pump until it reaches approximately 100% of the throat area.

7. The centrifugal pump of claim 6 in which said casing flow area at a point approximately 300° downstream from said cutwater, reaches 100% of throat area and continues at approximately 100% of said throat area from a point 300° downstream from said cutwater to said throat.

8. The centrifugal pump of claim 1 in which said casing flow area decreases as one proceeds from the upstream portion of the casing to the juncture portion of the casing until it reaches approximately 45% of the throat area in said juncture portion.

9. The centrifugal pump of claim 8 in which said casing flow area reaches 45% of the throat area at a point approximately 190° downstream from said cutwater and begins to gradually increase from a point approximately 190° downstream from said cutwater until it equals the flow area of a true volute casing at a point approximately 240° downstream from said cutwater.

10. The centrifugal pump of claim 1 in which said casing flow area increases in said downstream portion of said pump until it reaches approximately 100% of the throat area.

11. The centrifugal pump of claim 10 in which said casing flow area at a point approximately 300° downstream from said cutwater, reaches 100% of throat area and continues at approximately 100% of said throat area from a point 300° downstream from said cutwater to said throat.

12. In a centrifugal pump having an impeller, a casing, an inlet, a cutwater and a throat, the improvement in said pump comprising:

said casing being a modified volute casing having a casing flow area which increases sharply from said cutwater to approximately 60% of the throat area at a point approximately 40° downstream from said cutwater and continues at approximately 60% of said throat area to about 160° downstream from said cutwater;

said casing flow area thereafter decreasing sharply to about 45% of said throat area at a point approximately 190° downstream from said cutwater; and said casing thereafter increasing gradually to about 100% of said throat area at a point approximately 300° downstream from said cutwater and continuing at approximately 100% of said throat area to said throat.

13. A centrifugal pump having a casing, inlet, impeller, throat and cutwater, the improvement in said pump comprising: said casing being generally of a volute configuration but having modified casing flow areas for reducing radial thrust loading of the impeller, said modified casing flow areas defining, in the upstream portion thereof between the cutwater and a point generally 180° from said cutwater and through the portion located generally 90° from the cutwater, a flow area which is greater than would be the flow area of true volute casing in the same upstream casing portion.

14. A centrifugal pump having a casing, inlet, impeller, throat and cutwater, the improvement in said pump comprising: said casing being generally of a volute configuration but having modified casing flow areas for reducing radial thrust loading of the impeller, said modified casing flow areas defining, in the upstream portion thereof between the cutwater and a point generally 180° from said cutwater, a flow area which is greater than would be the flow area of true volute casing in the same upstream casing portion; said greater casing flow area increasing relatively rapidly in the upstream portion of the casing as one proceeds from the cutwater until said flow area is approximately 60% of the throat area.

15. The centrifugal pump of claim 14 in which said casing flow area increases from the cutwater and reaches 60% of the throat area at a point approximately 40° downstream from the cutwater, then continues at about 60% of the throat area until approximately 160° downstream from the cutwater at which point it begins to decrease.

16. A centrifugal pump having a casing, inlet, impeller, throat and cutwater, the improvement in said pump comprising: said casing being generally of a volute configuration but having modified casing flow areas for reducing radial thrust loading of the impeller, said modified casing flow areas defining a restricted flow area which is less than would be the flow area of a true volute in that portion of said casing located approximately 180° downstream from said cutwater and extending further downstream beyond such point, said restricted flow area including at least a portion which is about 45% of the throat area of the casing.

17. The centrifugal pump of claim 16 in which said restricted casing flow area reaches 45% of the throat area at a point approximately 190° downstream from said cutwater and begins to gradually increase from a point approximately 190° downstream from said cutwater until it equals the flow area of a true volute casing at a point approximately 240° downstream from said cutwater.

18. A centrifugal pump having a casing, inlet, impeller, throat and cutwater, the improvement in said pump comprising: said casing having a modified volute configuration with casing flow areas differing from those of a true volute casing for reducing radial thrust loading of the impeller, said modified casing defining a flow area in the downstream portion thereof, between the throat and a point generally 180° from the cutwater, which is greater than would be the flow area of true volute casing in the same downstream casing portion.

19. A centrifugal pump having a casing, inlet, impeller, throat and cutwater, the improvement in said pump comprising: said casing having a modified volute configuration with casing flow areas differing from those of a true volute casing for reducing radial thrust loading of the impeller, said modified casing defining a flow area in the downstream portion thereof, between the throat and a point generally 180° from the cutwater, which is greater than would be the flow area of true volute casing in the same downstream casing portion; said casing flow area, at a point approximately 300° downstream from said cutwater, reaching 100% of throat area and continuing at approximately 100% of said throat area from a point 300° downstream from said cutwater to said throat.

* * * * *